US006568532B1

(12) United States Patent
Leach

(10) Patent No.: US 6,568,532 B1
(45) Date of Patent: May 27, 2003

(54) CARD HOLDER BOX KIT

(76) Inventor: Carolyn S. Leach, 48129 Twp. 108, P.O. Box 145, Belle Valley, OH (US) 43717-0145

( * ) Notice: Subject to any disclaimer, the term of this patent is extended or adjusted under 35 U.S.C. 154(b) by 0 days.

(21) Appl. No.: 10/093,351

(22) Filed: Mar. 8, 2002

(51) Int. Cl.[7] ..... B65D 73/00
(52) U.S. Cl. ..... 206/457; 220/612; 229/116.4
(58) Field of Search ..... 206/223, 575, 206/231, 457, 459.5, 822, 449; 40/310, 312; 220/612; 229/116.1, 116.4, 103; 446/73, 75, 78, 471

(56) References Cited

U.S. PATENT DOCUMENTS

| | | | | | |
|---|---|---|---|---|---|
| 888,774 | A | | 5/1908 | Wood | |
| D81,676 | S | | 7/1930 | Webber | |
| 2,316,384 | A | | 4/1943 | Abramson | |
| D156,789 | S | | 1/1950 | Warner | |
| 3,016,178 | A | * | 1/1962 | Knocks | 229/116.2 |
| 3,439,444 | A | * | 4/1969 | Smith | 206/457 |
| 3,610,510 | A | | 10/1971 | Lowry | |
| 4,753,346 | A | | 6/1988 | Tsuji | |
| D338,620 | S | | 8/1993 | Brozowski | |
| 5,400,917 | A | * | 3/1995 | Stanton | 220/612 |
| 6,173,837 | B1 | * | 1/2001 | Marconi | 206/457 |
| 6,422,388 | B1 | * | 7/2002 | McCahey | 206/457 |

* cited by examiner

*Primary Examiner*—Luan K. Bui
(74) *Attorney, Agent, or Firm*—Donald R. Schoonover

(57) ABSTRACT

A kit includes a base unit, a top unit and decal units as well as adhesive so a container for cards can be formed. The kit can also include cards as well. The kit can be used to form a box having any suitable and desired shape.

9 Claims, 1 Drawing Sheet

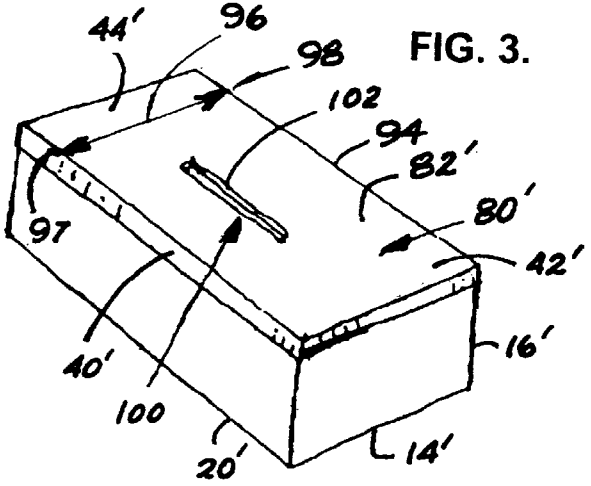
FIG. 3.
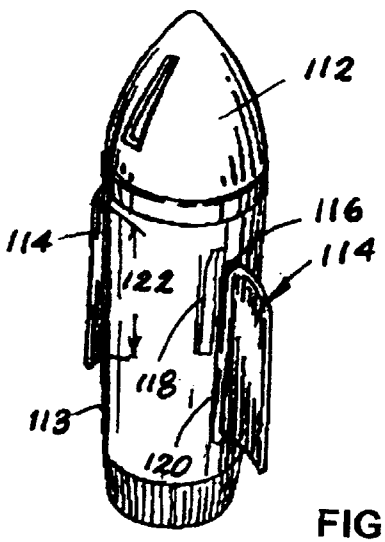
FIG. 4.
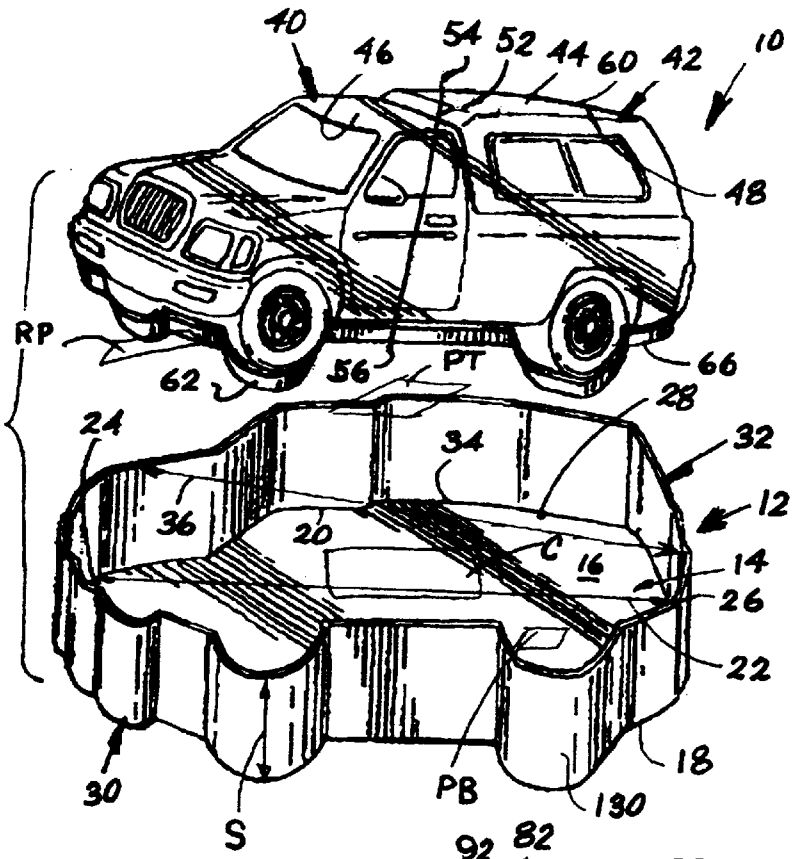
FIG. 1.
FIG. 2.

CARD HOLDER BOX KIT

BACKGROUND OF THE INVENTION

1. Field of the Invention

The present invention relates to the general art of containers, and to the particular field of special containers and kits for forming special containers.

2. Discussion of the Related Art

In recent times, nearly every special occasion has generated corresponding special cards which are given or exchanged. The most recognizable occasions of this sort are Valentine's Day, Birthdays, Anniversaries, and the like.

Often, people like to keep the cards they receive on such special occasions. The retained cards are often simply placed in a container. Sometimes, the cards are forgotten, especially if a number of different cards are stored in the same container.

Therefore, there is a need for a container that can be used to store special cards.

Many people, especially children, often like to personalize the cards they give in some manner that is more distinctive than simply writing on the card. This can be done by decorating the cards or the envelopes containing the cards. However, some people often wish to do more.

Therefore, there is a need for a means for permitting people to personalize cards given for an occasion more than simply writing on the card and/or decorating the envelope for the card.

PRINCIPAL OBJECTS OF THE INVENTION

It is a main object of the present invention to provide a container that can be used to store special cards.

It is another object of the present invention to provide a means for permitting people to personalize cards given for an occasion more than simply writing on the card and/or decorating the envelope for the card.

SUMMARY OF THE INVENTION

The kit embodying the present invention solves both of the above-mentioned problems by permitting a person to assemble a special container associated with an occasion and then give, or receive, cards that correspond to that container. Thus, the cards can be personalized to a degree greater than simply writing on the cards or decorating the cards or the envelopes and also provides a special container for storing the cards. The container can be given to an individual as part of the card exchange or kept by the recipient of the cards.

The kit of the present invention can contain both the container and a plurality of cards. A child can assemble the container to store cards he or she receives, or give the assembled container with one or more cards. For example, a kit associated with Valentine's Day may have a heart-shaped box containing heart-shaped cards. A person can assemble the box to store cards he or she receives. Alternatively, the person can give the assembled box to someone as a special gift and the recipient can then store cards he or she receives on that occasion. In either case, a person has a special container for cards received on a special occasion and a person can personalize a gift to a degree greater than is otherwise possible.

BRIEF DESCRIPTION OF THE DRAWINGS

FIG. 1 is a perspective view of a special container in a set-up configuration with a top unit separated from a bottom unit.

FIG. 2 is an elevational view of a decal unit included in the kit of the present invention.

FIG. 3 is a perspective view of a blank container.

FIG. 4 is a perspective view of another form of special container formed by a kit embodying the present invention in an assembled, set-up configuration.

DETAILED DESCRIPTION OF THE INVENTION

Other objects, features and advantages of the invention will become apparent from a consideration of the following detailed description and the accompanying drawings.

Referring to FIG. 1, it can be seen that the present invention is embodied in a kit 10 for forming a special container. Kit 10 is shown in the set-up configuration for ease and economy of description. However, the kit 10 is initially in a knocked down configuration as can be visualized by one skilled in the art. Furthermore, cards as indicated in FIG. 1 at C, can be stored in the set-up container and can be sold with the kit 10 as a unit. Cards C can be smaller than the set-up container or can be of comparable size. Kit 10 comprises a base unit 12, which includes a planar bottom wall 14 having a first surface 16 and a second surface 18 which forms the bottom of the container in the set-up configuration. Base unit 12 further includes a perimeter 20 having a pre-selected shape such as the car shape shown in FIG. 1, or a rocket shape as shown in FIG. 4, or the like, as will be understood by those skilled in the art based on the teaching of this disclosure. Accordingly, bottom wall 14 includes bottom wall dimensions, such as bottom wall dimension 22, measured across bottom wall 14 from one location 24 on perimeter 20 of bottom wall 14 to a corresponding location 26 on perimeter 20 of bottom wall 14. As will be understood, bottom wall dimensions will vary according to the shape of perimeter 20.

Kit 10 further includes adhesive 28 which can be adhesive common to stationery items and which is placed on surface 16 of bottom wall 14 adjacent to perimeter 20 for a purpose that will be understood from the following disclosure.

Kit 10 further includes a continuous sidewall 30 which, like the bottom unit 12 can be formed of cardboard or cardboard-like materials and which includes a top rim 32, a bottom rim 34 which is fixed to first surface 16 of bottom wall 14 at perimeter 20 of bottom wall 14. When sidewall 30 is fixed to bottom wall 14, sidewall 30 has a shape corresponding to the pre-selected shape of perimeter 20 of bottom wall 14 with top rim 32 of sidewall 30 spaced apart from bottom rim 34 of sidewall 30, and top rim 32 of sidewall 30 is in a plane PT that is parallel to plane PB containing planar bottom wall 14 of base unit 12.

Sidewall 30 includes sidewall dimensions, such as dimension 36, that are equal to corresponding dimensions on bottom wall 14 of base unit 12 when sidewall 30 is fixed to bottom wall 14. Sidewall 30 of base unit 12 has a length S measured between top rim 32 of sidewall 30 and bottom wall 14 of base unit 12.

Kit 10 further includes a top unit 40 which includes a top wall 42 having a first surface 44, a second surface 46, a perimeter 48 which has the pre-selected shape of perimeter 20 of bottom wall 14 of base unit 12. Top unit 40 includes top unit dimensions, such as dimension 52, which are measured from one point 54 on perimeter 48 of top wall 42 of top unit 40 across top wall 42 of top unit 40 to a second point 56 on perimeter 48.

Adhesive material 60, such as glue or the like, is located on top wall 42 at perimeter 48.

Top unit 40 further includes a continuous outer wall 62 attached to top wall 42 of top unit 40 by adhesive 60 at perimeter 48 of top wall 42. In the set-up configuration, outer wall 62 extends away from top wall 42 when outer wall 62 is affixed to top wall 62 and has a shape corresponding to the pre-selected shape of perimeter 20 of bottom wall 14 of base unit 12 and includes a rim 66 which is spaced from top wall 42 and is in a rim plane RP. Top unit dimensions, such as dimension 52, are slightly larger than corresponding dimensions, such as dimension 22, of sidewall 30 of base unit 12 when sidewall 30 is fixed to bottom wall 14 by adhesive 28 so outer wall 62 of top unit 40 surrounds sidewall 30 of base unit 14 in a set-up configuration.

Kit 10 further includes a decal unit 80 as shown in FIG. 2 which includes a first surface 82, a second surface 84 and adhesive 86 on second surface 84. Adhesive 86 is a pressure-type adhesive that adheres to an object upon pressure being applied as is known to those skilled in the art. A release sheet 88, covers pressure adhesive 86 when decal unit 80 is stored and is removed when decal 91 is drawn off release sheet 88, as indicated by arrow 92. One form of decal unit 80 is indicated in FIG. 3 as decal unit 80' and has a perimeter 94 which has the pre-selected shape of the perimeter 20' of bottom wall 14' of base unit 16'. The decal unit 80' also includes decal dimensions, such as decal dimension 96, which are measured from one point 97 on perimeter 94 of the decal unit 80' across first surface 82' of decal unit 80' to a second point 98 on the perimeter 94 of the decal unit 80'. The decal dimensions are equal to corresponding sidewall dimensions of top unit 40' so decal unit 80' covers first surface 44' of the planar top wall 42' of top unit 40' when decal unit 80' is in place on the top wall 42' of top unit 40' in the set-up configuration.

As can be seen in FIG. 1, if the top unit 40 has an unusual shape, several decal units can be used. For example, one decal unit can cover a portion or all of the top surface of the top unit, another decal unit can cover one portion of the top unit outer wall, another decal unit can cover another portion of the outer wall, and so forth. In the form shown in FIG. 1, special decal units can be used to represent tires of an automobile, other decal units can be used to represent side panels, and so forth as will be understood by those skilled in the art based on the teaching of this disclosure.

In one form of the kit, an opening 100 is defined through the top wall 42' of the top unit 40' so cards can be passed through the opening 100 for storage inside the set-up container. A corresponding opening 102 is defined through the decal unit 80' to be superposed over opening 100 when the decal unit 80' is in place on the top unit 40'.

A further form of the kit is shown in FIG. 4 and includes an arcuate top unit 112 as well as accessory elements, such as accessory element 114. Each accessory element 114 includes a layer of adhesive 116 which attaches the accessory element 114 to the outer wall of the top unit 112 or to the sidewall of the bottom or base unit 113 as desired, and a release sheet 118 covering the layer of adhesive on each accessory element which is removed to attach the accessory element 114 to the rest of the container, as indicated in FIG. 4, with the release sheet 118 having been removed from the accessory element 114. Each accessory element 114 has a perimeter 120 with a maximum dimension 122 which is smaller than length S of the sidewall of the base unit 113.

As can be seen in FIGS. 1, 3 and 4, sidewall 30 can have any desired shape and can include a plurality of curved portions, such as curved portion 130, to define the desired shape of the container.

It is understood that while certain forms of the present invention have been illustrated and described herein, it is not to be limited to the specific forms or arrangements of parts described and shown.

I claim:

1. A kit for forming a special container comprising:

a) a base unit which includes
  (1) a planar bottom wall having
    (a) a first surface,
    (b) a second surface,
    (c) a perimeter having a pre-selected shape, and
    (d) bottom wall dimensions measured across the bottom wall from one location on the perimeter of the bottom wall to a corresponding location on the perimeter of the bottom wall,
  (2) adhesive,
  (3) a continuous sidewall which includes
    (A) a top rim,
    (B) a bottom rim,
    (C) the bottom rim of the sidewall being fixed to the first surface of the bottom wall at the perimeter of the bottom wall,
    (D) when the sidewall is fixed to the bottom wall, the sidewall having a shape corresponding to the pre-selected shape of the perimeter of the bottom wall with the top rim of the sidewall being spaced apart from the bottom rim of the sidewall and the top rim of the sidewall being in a plane that is parallel to the plane containing the planar bottom wall of said base unit,
    (E) the sidewall including sidewall dimensions that are equal to corresponding dimensions on the bottom wall of said base unit when the sidewall is fixed to the bottom wall, and
    (F) the sidewall of said base unit having a length measured between the top rim of the sidewall of said base unit and the bottom wall of said base unit;

b) a top unit which includes
  (1) a top wall having
    (A) a first surface,
    (B) a second surface,
    (C) a perimeter having the pre-selected shape of the perimeter of the bottom wall of said base unit, and
    (D) top unit dimensions which are measured from one point on the perimeter of the top wall of said top unit across the top wall of said top unit to a second point on the perimeter of the top wall of said top unit,
  (2) adhesive material,
  (3) a continuous outer wall attached to the top wall of said top unit by said adhesive at the perimeter of the top wall of said top unit, the outer wall extending away from the top wall of said top unit when affixed to the top wall of said top unit by said adhesive material and having a shape corresponding to the pre-selected shape of the perimeter of the bottom wall of said base unit and including a rim which is spaced from the top wall of said top unit and being in a rim plane, the top unit dimensions being slightly larger than the dimensions of the sidewall of said base unit when the sidewall of said base unit is fixed to the bottom wall of said base unit by said adhesive so the outer wall of said top unit surrounds the sidewall of said base unit in a set-up configuration; and c) a decal unit which includes (1) a first surface,
(2) a second surface,
(3) pressure adhesive on the second surface,
(4) a release sheet covering the pressure adhesive,
(5) a perimeter having the pre-selected shape of the perimeter of the bottom wall of said base unit,
(6) decal dimensions which are measured from one point on the perimeter of said decal unit across the first surface of said decal unit to a second point on the perimeter of said decal unit, and
(7) the decal dimensions being equal to the sidewall dimensions of said top unit so said decal unit covers the first surface of the planar top wall of said top unit when said decal unit is in place on the top wall of said top unit in the set-up configuration.

2. The kit as described in claim 1 further including an opening defined through the planar top wall of said top unit.

3. The kit as described in claim 2 further including an opening defined through said decal unit and located to be superimposed over said opening defined through the planar top wall of said top wall unit in the set-up configuration.

4. The kit as described in claim 3 wherein the top wall of said top unit is planar and the rim plane of the outer wall of said top unit is parallel to a plane containing the planar top wall of said top unit.

5. The kit as described in claim 2 further including accessory elements, with each accessory unit including
(1) a layer of adhesive,
(2) a release sheet covering the layer of adhesive on each accessory element,
(3) each accessory element having a perimeter with a maximum dimension, and
(4) the maximum dimension of the perimeter of each accessory element being smaller than the length of the sidewall of said base unit.

6. The kit as described in claim 5 wherein the top wall of said top unit is arcuate in shape.

7. The kit as described in claim 1 wherein the sidewall of said base unit includes a plurality of curves.

8. The kit as described in claim 7 further including further decals which include maximum dimensions that are smaller than the length of the sidewall of said base unit.

9. The kit as described in claim 8 wherein said further decals are located on the outer wall of said top unit.

* * * * *